United States Patent [19]

Nilsson

[11] Patent Number: 4,876,942

[45] **Date of Patent: * Oct. 31, 1989**

[54] ANTI-AIRCRAFT SIGHT

[75] Inventor: Hans-Arne Nilsson, Ulricehamn, Sweden

[73] Assignee: Saab Instruments Aktiebolag, Jönköping, Sweden

[ * ] Notice: The portion of the term of this patent subsequent to Apr. 25, 2006 has been disclaimed.

[21] Appl. No.: 322,690

[22] Filed: Mar. 13, 1989

Related U.S. Application Data

[63] Continuation of Ser. No. 44,850, filed as PCT SE86/00372 on Aug. 19, 1986, published as WO87/01190 on Feb. 26, 1987, Pat. No. 4,823,674.

[30] Foreign Application Priority Data

Aug. 19, 1985 [SE] Sweden ..... 8503860

[51] Int. Cl.[4] ..... F41G 3/06; F41G 5/08

[52] U.S. Cl. ..... 89/41.22; 33/238; 235/411

[58] Field of Search ..... 89/41.22, 41.09; 33/238, 236, 237; 235/411, 412, 413, 414, 415, 416

[56] References Cited

U.S. PATENT DOCUMENTS

| | | | |
|---|---|---|---|
| 2,538,821 | 1/1951 | Wheeler | 89/41.22 |
| 2,705,371 | 4/1955 | Hammond | 89/41.09 |
| 3,135,053 | 6/1964 | Newman et al. | 235/412 |
| 3,845,276 | 10/1974 | Kendy et al. | 89/41.22 |
| 3,848,509 | 11/1974 | Corn | 89/41.22 |
| 3,992,708 | 11/1976 | Olson et al. | 235/411 |
| 4,004,729 | 1/1977 | Rawicz et al. | 33/238 |
| 4,011,789 | 3/1977 | Bresee et al. | 235/416 |
| 4,146,780 | 3/1979 | Sprey | 89/41.22 |
| 4,266,463 | 5/1981 | Saltin | 89/41.22 |
| 4,402,250 | 9/1983 | Baasch | 89/41.22 |

*Primary Examiner*—David H. Brown

*Attorney, Agent, or Firm*—James E. Nilles; James R. Custin

[57] ABSTRACT

A sight for an anti-aircraft gun, which is manually aimed, comprises a ranging unit, a gun-fixed aiming unit and a calculating unit, preferably a computer. The ranging unit comprises means for optical aiming at the target, and devices for determination of the range, the angular rate in elevation and azimuth, and elevation. The devices emit measured value signals to the means for optical aiming at the target, which means is settable in elevation and azimuth in relationship to the firing direction of the anti-aircraft gun. The calculating unit controls, guided by said received signals and information given about the velocity of the fired projectile and the prevailing wind vector, the second optical means in such a way that when the operator aims through same at the target by setting the barrel in elevation and azimuth, the offset and lead angles of the barrel are such that a fired projectile hits the target. The invention is characterized in that the ranging unit (1) is separate, comprising a support (9), manually pivotable in elevation and azimuth, independent of the firing direction of the barrel.

2 Claims, 3 Drawing Sheets

ANTI-AIRCRAFT SIGHT

RELATED APPLICATION

This application is a continuation of the applicant's copending application Ser. No. 044,850, filed as PCT SE86/00372 on Aug. 19, 1986, published as WO87/01190 on Feb. 26, 1987, now U.S. Pat. No. 4,823,674.

FIELD OF THE INVENTION

The present invention relates to a sight whereby an anti-aircraft gun or the like, is manually aimed in elevation and azimuth at a mobile target, said sight comprising a ranging unit, an aiming unit fixed to the gun, and a calculating unit that is preferably a computer. The ranging unit comprises first means for optical aiming at the target along a first aiming line, preferably field glasses, a device for ranging to the target, preferably of the laser type, and devices for measuring the angular rates of the aiming line in elevation, and azimuth, preferably gyros. The sight also comprises a device for measuring the elevation which at least contributes to the measurement of the elevation of the ranging unit, preferably an electrically sensed pendulum. Said mentioned devices are arranged to emit signals corresponding to their respective measured values to the calculating unit. The aiming unit comprises second means for optical aiming at the target, which means is controllable in elevation and azimuth in relationship to the firing direction of the anti-aircraft gun. The calculating unit, guided by said received signals and information given about the velocity of the projectile fired from the anti-aircraft gun and the prevailing wind vector, is arranged to control the second optical means so that when aiming through same at the target, the lead angle and the offset angle of the barrel of the anti-aircraft gun are such that a fired projectile will hit the target.

BACKGROUND OF THE INVENTION

When fighting against mobile targets with an anti-aircraft gun there are different methods for aiming. The most simple one, but also the least reliable, implies so-called direct aiming, in which the aiming operator judges, by experience, the lead angle and the offset angle during tracking of the target through a simple ring sight. The aiming is entirely manual. In order to improve such manual aiming of an anti-aircraft gun its barrel has been provided with gyros for measuring its angular rates that emit signals corresponding to the angular rates of the barrel in elevation and azimuth to a calculating unit which in turn emits control signals to an optical sight, the aiming line of which is controllable in relationship to the direction of the barrel of the anti-aircraft gun. The control signals have the object to control the sight in relationship to the firing direction, so that the aiming operator, by aiming at the target and simultaneously setting the firing direction in elevation and azimuth, shall bring about such lead and offset angles that a fired projectile will hit the target. As the gyros for measuring the angular rates are fixed to the gun, the measurement is disturbed by their movement together with the setting of the barrel, so that the method implies a dependent aiming line method.

The development of systems for fire-control of anti-aircraft guns comprises remote control of barrels from a central ranging unit from which the range to the target is determined and its velocity and track in an earth-bound coordinate system, and with the aid of a calculating unit the anti-aircraft gun is remotely controlled by servo means, so that the lead and offset angles for the barrel are the correct ones for firing the projectile. The range determination in such a central ranging unit is carried out by radar or by a laser meter provided with a thoroughly gyro stabilized sight. Such equipment is expensive and complicated. The manual aiming of the barrel is completely eliminated in these fire-control systems, which apply an independent aiming line method.

As there are still several manually aimed anti-aircraft guns, which are not suited to rebuild for remote control, there is a demand for a sight for the application of an independent aiming line method for manually aimed anti-aircraft guns. This sight should be simple and reliable and should permit a high degree of hit precision. The object of the invention is thus to provide a sight of the type mentioned introductorily, which bears said desired features and, further, is so stable when aiming without gyro-stabilizing that the range determination can be carried out simply by a laser meter.

Such a sight is characterized, according to the invention, in that the ranging unit is separate, comprising a support, manually pivotable in elevation and azimuth, independent of the firing direction of the anti-aircraft gun. The sight can be designed in many ways, either carried by an operator or by a stand which can be located at a distance from the anti-aircraft gun, or be mounted on the barrel of the anti-aircraft gun. In one embodiment the support of the ranging unit is pivotable in elevation around a substantially horizontal first axis in a yoke intended to be carried and be turned in azimuth by an operator. Suitably the yoke is designed to be carried on the shoulders of an operator.

The embodiment just described, where an operator is presumed to carry the ranging unit, can be advantageous in many cases. Considering that the ranging unit is normally rather heavy, an embodiment may in some cases be preferable where the support is pivoted in elevation around an axis which is carried by a portable stand. The turnability in azimuth can be achieved by a bearing or by suspension in an elastic element like a strong rubber band. Even in this case it is presumed that an operator is present below the stand, handling same in elevation and azimuth.

One further embodiment shows advantages in some cases. In it the support of the ranging unit is pivoted in elevation and azimuth in a base which is firmly connected to the barrel of the anti-aircraft gun. In order to improve the possibilities for a safe aiming it is suitable to provide the support of the ranging unit with a handle, arranged to act upon the elevation and azimuth movement by reduction of movement when the operator acts upon the handle.

In the last mentioned embodiment the ranging unit is located, together with the first optical means, at a small distance from the aiming unit with its second optical means. Thus the calculating unit is suitably arranged to correct the angle difference between the aiming lines through the first and the second optical means, depending upon a signal given to the calculating unit, corresponding to the mutual positions of said optical means; but in the last mentioned embodiment this angle difference may be of negligible value in most cases, and in such cases need not be taken into account.

BRIEF DESCRIPTION OF THE DRAWINGS

The invention will now be described more in detail, reference being made to the accompanying FIGS., in which.

DESCRIPTION OF THE PREFERRED EMBODIMENT

Figure 1:
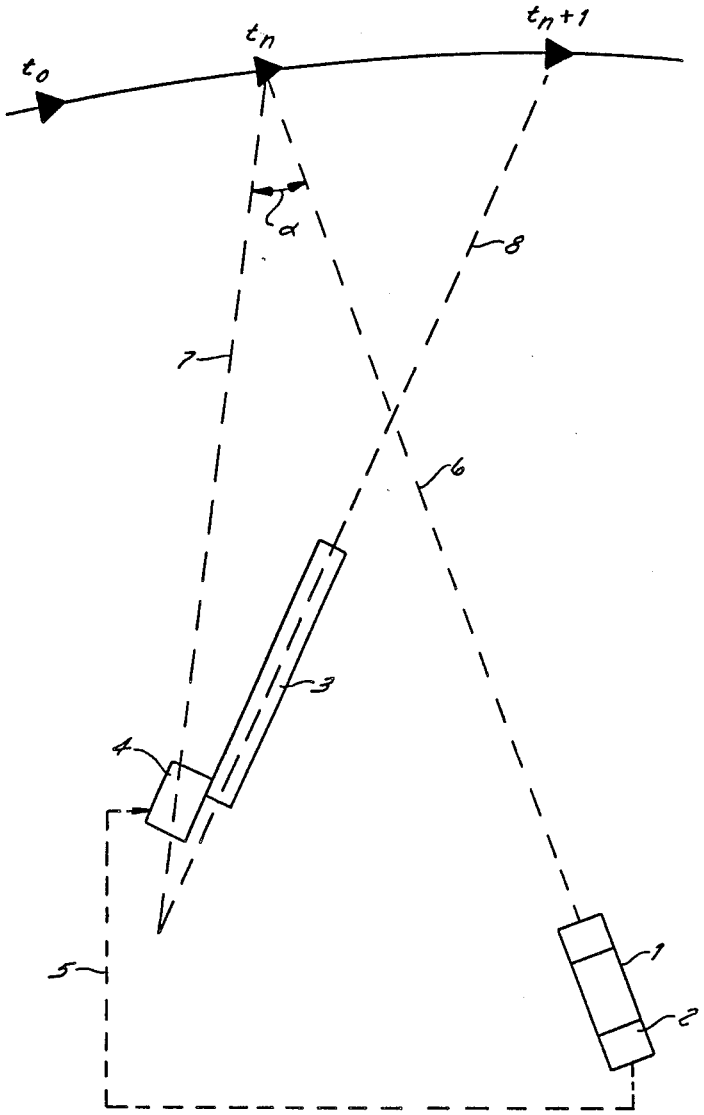
FIG. 1 shows, schematically, seen from above, an embodiment of the sight of the invention, utilized when shooting with an anti-aircraft gun.

In FIG. 1, 1 designates a ranging unit according to the invention and 2 a calculating unit. The latter is in this case mounted on the former. An anti-aircraft gun, which is aimed manually, is shown exclusively with a barrel 3, which is firmly connected to an aiming unit 4. The calculating unit 2 is connected to the aiming unit 4 by an electrical cable. In practice this connection can be arranged in such a way that an electrical cable 5 leads to the lower gun-carriage of the anti-aircraft gun, from which the signal transfer to the aiming unit 4, which is located in the corresponding upper gun-carriage, is carried out by inductive transmission. With this arrangement the upper gun-carriage can be turned freely in relationship to the lower gun-carriage. A mobile target moves in a track which is marked by the three successive positions $t_o - t_n - t_{n+1}$. By the aid of the ranging unit 1 the target is aimed at along a first aiming line 6, which in its initial position is thus aiming at the target in the position $t_o$. By determining the range to the target and tracking it, so that the velocity and the track are determined, measured values are obtained, which are converted by the calculating unit 2 into control signals which control the aiming means 4 of the aiming unit 6 in such a way that when the aiming operator sets the barrel 3 of the anti-aircraft gun, a second aiming line 7 aims at the target, the barrel 3 being directed in such a way that a fired projectile will hit the target after a projectile track in the position $t_{n+1}$, considering the prevailing wind vector, the velocity of the fired projectile and correction for the angles in elevation and azimuth between the aiming lines 6, 7 (of which only the latter is shown in FIG. 1) considering that the ranging unit 1 and the aiming unit 4 are located at substantially different positions. Thus the aiming lines 6, 7 are shown in FIG. 1 in the moment when the acquisition has been going on for so long a time that the projectile can be fired with a sufficiently high degree of probability for a hit against the target in the position $t_{n+1}$.

Figure 2:
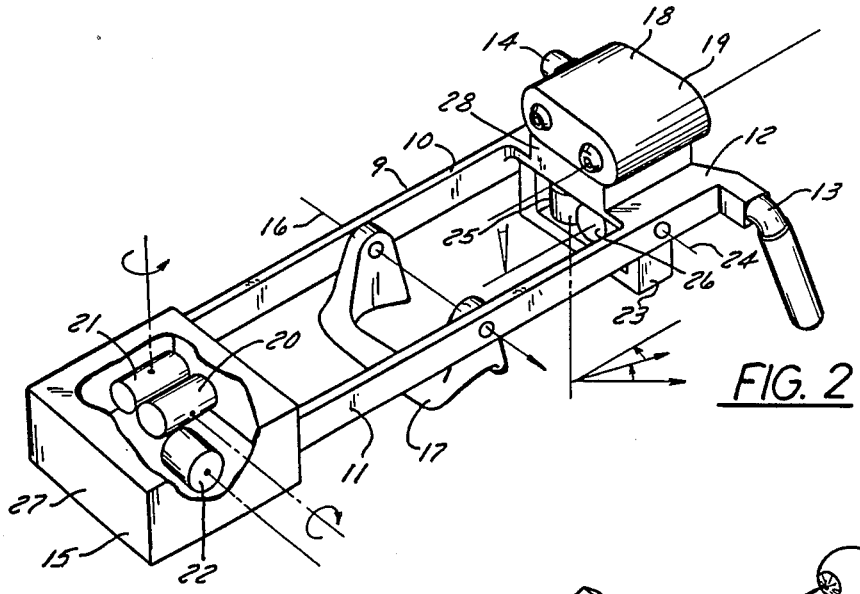
FIG. 2 shows, seen in perspective, one embodiment of a ranging unit according to the invention.

In FIG. 2 the design of the ranging unit 1 is shown more in detail. A support 9 is formed by two long narrow beams 10, 11, in one end joined by a support plate 12, which is provided with two handles 13, 14, and in the other end joined by a container 15. The support 9 is at about the middle of the longitudinal extension of the beams 10, 11 pivoted around a horizontal axis 16 in a yoke 17, designed to be carried by an operator's shoulders. At the support plate 12 there is attached field-glasses 18 for optical aiming at the target. These field-glasses also comprise a laser range finder 19. In the container 15 there are placed gyros for angular rate measurement, for measuring in elevation 20, and azimuth 21. In the container 15 there is also a first electrically sensed pendulum 22 for elevation measurement. In the front part of the support a cradle is pivoted around a laterally extending axis 24, which is horizontal, perpendicular to the longitudinal extension of the support and thus parallel to said axis 16. In this cradle 23 an electrically sensed compass 25 is placed, as well as a second electrically sensed pendulum 26, provided to determine any deviation of the direction of the axis 24 and thus the direction of the axis 16 in relationship to the horizontal plane.

Signals corresponding to the measured values from the laser range finder 19, the gyros 20, 21 and the compass 25 and the pendulums 22 and 26 are fed to one calculating unit 27, which is not shown more in detail, placed in the container 15.

In the front part of the support 9, below the field-glasses 18, there is one instrument display 28, which is not shown in detail, where data of wind vector, projectile velocity and the position of the ranging unit in relationship to the aiming unit is set by the operator.

Figure 3:
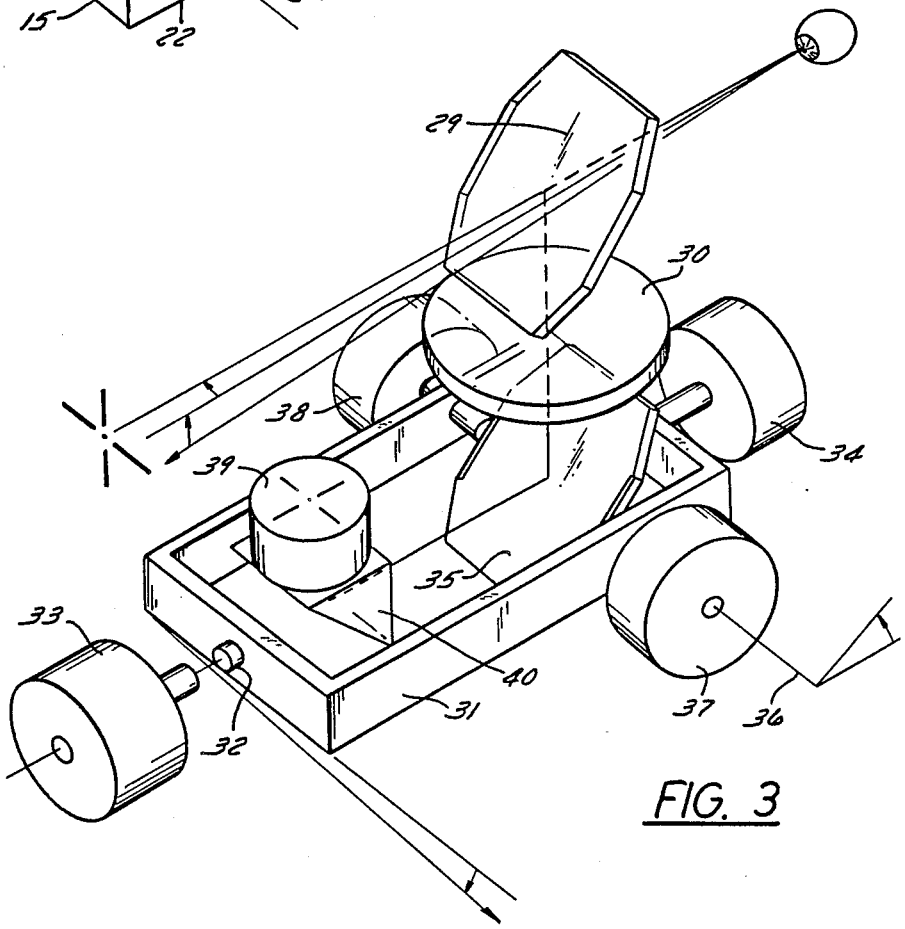
FIG. 3 shows, seen in perspective, a second optical means, which is part of an aiming unit according to the invention.

The optical means of the aiming unit 4 are shown partly in FIG. 3, where 29 designates a semi-transparent first mirror, attached to the aiming unit 4, which is connected to the barrel 3. The same is true for a lens 30. A cradle 31 is provided, pivoted around an axis 32, perpendicular to the optical axis of the lens 30, and situated in the same plane as this. The cradle 31 is controllably turnable around the axis 32 by the aid of a first torque motor 33, firmly connected to the aiming unit, and a corresponding first position transducer 34. In the cradle 31 a second mirror 35 is provided, pivoted around an axis 36, perpendicular to the axis 32. The mirror 35 is controllably turnable around the axis 36 by the aid of a second torque motor 37, firmly connected to the cradle 31, and a corresponding second position transducer 38. In the cradle 31 there is a symbol generator 39, which creates a reticle pattern, which is projected, via a prism 40, by the second mirror 35, through the lens 30 and via the semi-transparent first mirror and seems to be visible at an infinite distance from an observer, who looks through the first, semi-transparent mirror 29. By turning the cradle 31 around the axis 32 and the mirror 35 around the axis 36, the reticle will be displaced in azimuth and elevation. These turning movements are controlled, as is obvious from what is said above, by the calculating unit guided by the signals received by same, in such a way that when the aiming operator sets the barrel 3 in elevation and azimuth, with the object to aim through the optical means of the aiming unit 4 so that said reticle coincides with the target, the barrel will be directed in such a way that a fired projectile will hit the target.

The simple, balanced design of the ranging unit permits a stabilized ranging of the target without any expensive gyro stabilization. The stability is such that the necessary ranging can be carried out by a simple laser range finder, measuring in intervals of about 0.5 to 1 second. Such a finder has normally a beam divergence of 1–2 mradians, which means that the sight stability must be of corresponding quality. According to the invention there is applied a safe, independent aiming line method for manually aiming of an anti-aircraft gun.

Figure 4:
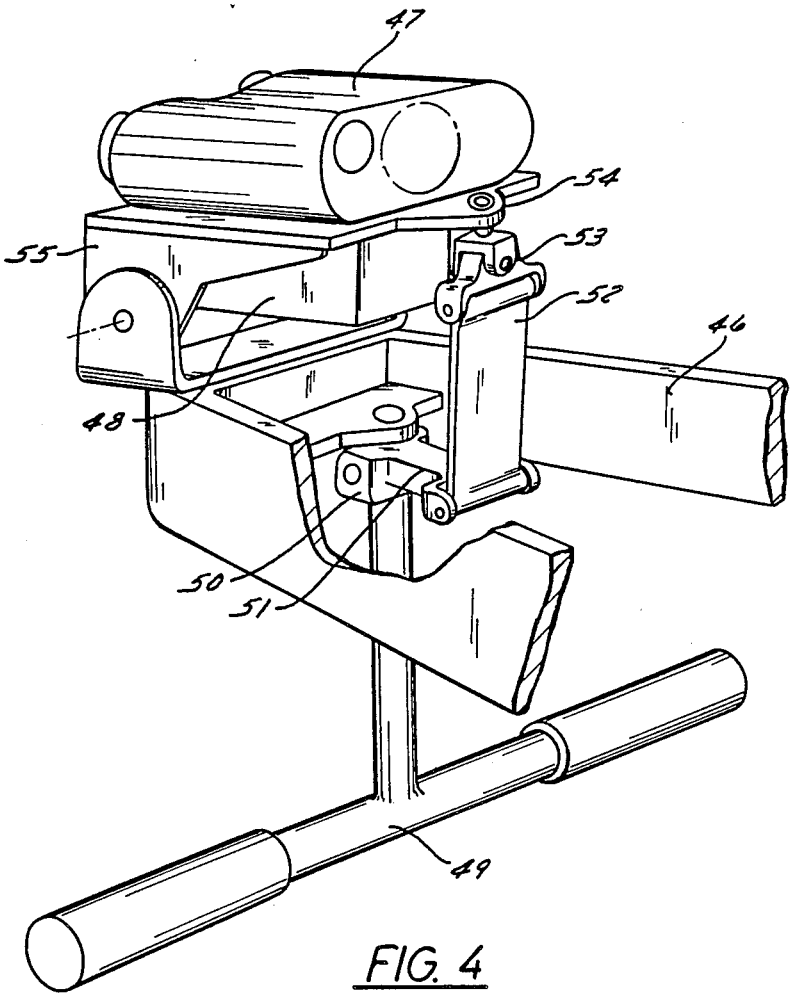
FIG. 4 shows, seen in perspective, one further embodiment of a ranging unit according to the invention.

In the embodiment shown in FIG. 4, the ranging unit is mounted, pivoted in elevation and in azimuth, in a support 46, which is attached to the barrel of the anti-aircraft gun. Field-glasses and range finder are here denoted by 47, while a unit 48 contains devices for angular rates and elevation angle measurement. The latter can also be placed at the barrel, in which case the elevation of the ranging unit is obtained by combination of the value from the device for elevation measurement and the value from an angular position transducer which measures the angle between the direction of the barrel and the elevation of the ranging unit. There is no need for a device for azimuth measurement in this case. In this embodiment the calculating unit is suitably separated from the ranging unit. By a handle 49, the field-glasses and the range finder 47 will be directed in elevation and azimuth by the operator, via a link system, which reduces the movement, for instance in the relationship 3:1, in order to improve the safety of the aiming.

In this case the link system comprises a fork link 51, firmly connected to the handle, pivoted in elevation and azimuth in the support 46. This fork link 51 is connected to a link 52, connected via a cardan to a journal 54, pivoted laterally in a support 55, which carries the field-glasses and the range finder 47 and the unit 48. This support 55 is pivoted in elevation and azimuth to the base 46. There are, of course, other constructive solutions to the problem of aiming a ranging unit in elevation and azimuth in relationship to a gun-fixed base. The design shown is however robust and reliable.

The last described embodiment of the ranging unit has the advantage that the anti-aircraft gun with operator constitutes a defined unit, the operator serving the ranging unit has not the same liberty of movement as in the cases when he himself carries a free ranging unit.

What is claimed is:

1. A ranging unit for a gun such as an anti-aircraft gun that is normally fired at moving targets and comprises a barrel with a barrel axis, an aiming unit which is mounted on the barrel for angular adjusting motion relative to it and which defines an aiming axis that a gunner manually maintains aligned on a target during a period terminating at an instant of firing to thus aim the barrel, and servo means reacting between the barrel and the aiming unit and responsive to outputs from a calculating device for angularly adjusting said aiming axis relative to said barrel axis in accordance with lead and offset angles needed for a projectile fired from the gun to hit the target, said ranging unit comprising:

A. a base;

B. optical means fixed on said base through which an operator can view a target and which defines a sighting axis that the operator can maintain aligned on a target by moving the base;

C. first pivoting means providing a connection between said base and said barrel whereby the base is constrained to move with the barrel but is pivotable relative to the barrel for swinging said sighting axis in azimuth and in elevation relative to said barrel axis;

D. a laser ranging device fixed on said base and connected with said calculating device, said laser ranging device being arranged (1) to emit and receive laser beam radiations along a laser axis substantially coinciding with said sighting axis and (2) to produce range outputs which correspond to distances from the sighting unit to a target aligned with said sighting axis and which are delivered to said calculating device as inputs for the latter;

E. means on said base for measuring values of (1) the elevation angle of said sighting axis and (2) the rates of change in azimuth and elevation of said sighting axis, and for producing inputs to said calculating device corresponding to those measured values;

F. a handle for imparting movements to said base; and

G. second pivoting means providing a connection between said handle and said barrel whereby the handle is constrained to move with the barrel but is movable relative to said barrel axis in directions corresponding to azimuth and elevation.

2. The ranging unit of claim 1, further characterized by:

H. link means providing a connection between said handle and said base whereby the latter is constrained to move in directions corresponding to movements of the handle but whereby such movements of the base are effected with a predetermined reduction of magnitude relative to movements of the handle.

* * * * *